US006167816B1

(12) United States Patent
Lavery et al.

(10) Patent No.: US 6,167,816 B1
(45) Date of Patent: Jan. 2, 2001

(54) SINGLE SCREW BRIDGEPLATE

(75) Inventors: Evin Lavery, Dublin 4 (IE); Fotios Golemis, Skokie, IL (US)

(73) Assignee: Westinghouse Air Brake Company, Wilmerding, PA (US)

( * ) Notice: Under 35 U.S.C. 154(b), the term of this patent shall be extended for 0 days.

(21) Appl. No.: 09/092,838

(22) Filed: Jun. 5, 1998

(51) Int. Cl.[7] ..... B61C 17/04
(52) U.S. Cl. ..... 105/458
(58) Field of Search ..... 105/458

(56) References Cited

U.S. PATENT DOCUMENTS 5,357,869 10/1994 Barjolle et al. .
5,775,232 * 7/1998 Golemis et al. ..... 105/458

* cited by examiner

*Primary Examiner*—S. Joseph Morano
*Assistant Examiner*—Robert J. McCarry, Jr.
(74) *Attorney, Agent, or Firm*—James Ray & Associates

(57) ABSTRACT

The present invention is a cartridge bridge plate assembly for mounting under a floor structure of a transit vehicle adjacent a door opening. It has a frame assembly and means for attaching the frame assembly underneath the floor structure of the vehicle. It has a bridge plate for covering a gap between the floor of the vehicle and an adjacent surface to facilitate passenger ingress and egress when the vehicle is stopped. It has a bridge plate positioning means for positioning the bridge plate and accommodating motion of the bridge plate from a stowed position within the frame assembly to an extended position for covering the gap. A motor is connected to the bridge plate positioning means for moving the bridge plate from the stowed position to the extended position and from the extended position to the stowed position. The system includes a power connection to the motor, and a drive screw connected to and rotated by the motor. It has a drive nut engaging the drive screw to be translated thereby, the drive nut having mechanical connection to the bridge plate positioning means to move the bridge plate from the stowed position to the extended position and from the extended position to the stowed position. The system also has an elevating means connected to the bridge plate positioning means for elevating an inner edge of the bridge plate to match an elevation of the floor surface of the transit vehicle.

13 Claims, 7 Drawing Sheets

FIG. 1
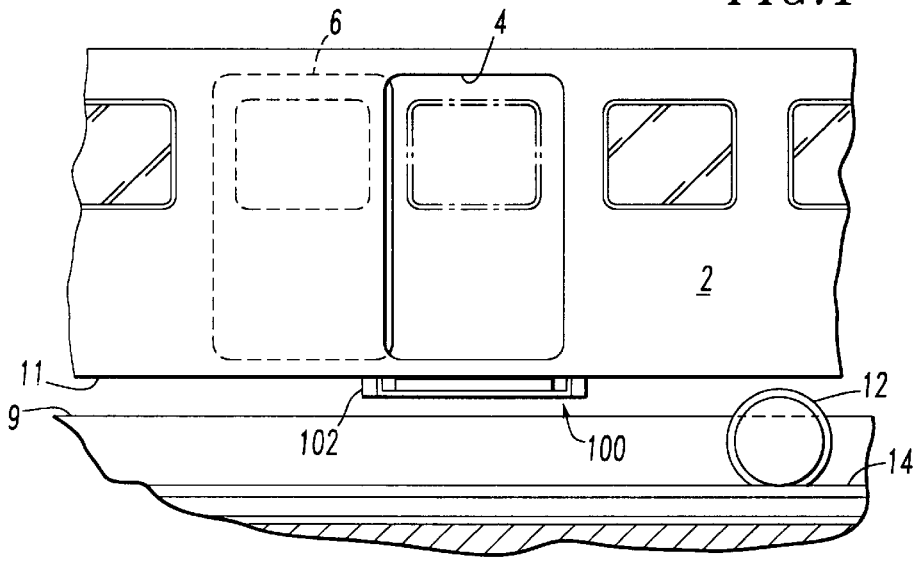
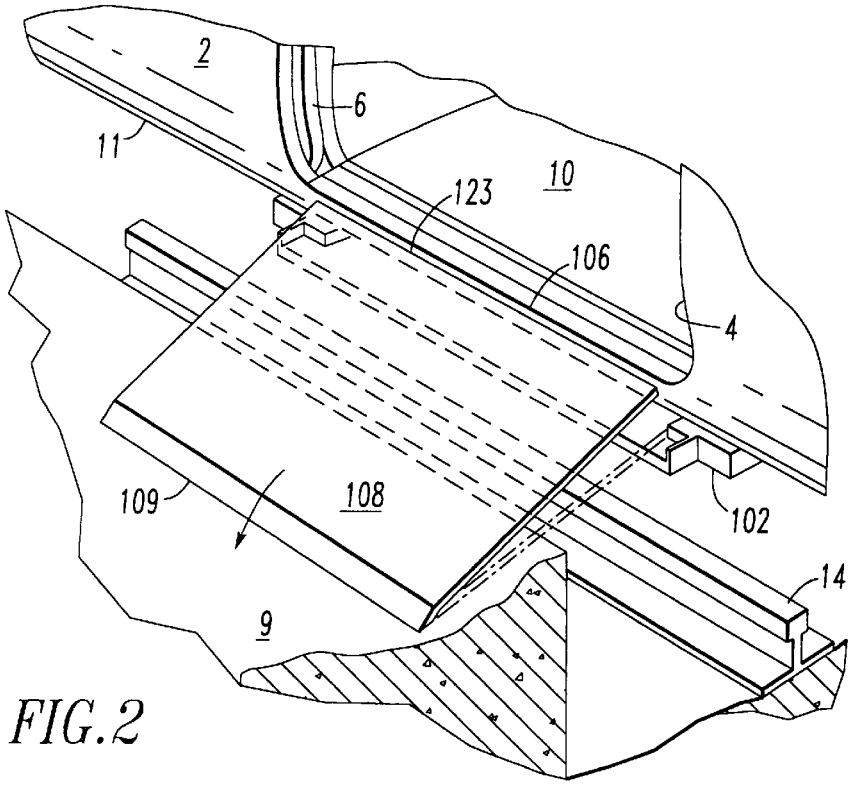
FIG. 2

SINGLE SCREW BRIDGEPLATE

CROSS-REFERENCE TO RELATED APPLICATIONS

The invention taught in this patent application is closely related to the invention taught in the following allowed patent application: Bridge Plate for a Mass Transit Vehicle, Ser. No. 08/799,165. The referenced application is assigned to the entity to which the present invention will be assigned. The teachings of the referenced application are incorporated herein by reference thereto. These teachings may be useful to a person skilled in the art for implementing the present invention.

FIELD OF THE INVENTION

The present invention relates, in general, to door systems for mass transit vehicles, and, more particularly, relates to bridge plates for facilitating ingress into and egress from mass transit vehicles.

BACKGROUND OF THE INVENTION

This invention relates generally to providing improved passenger access to mass transit vehicles, and more particularly concerns devices which extend outward from the side wall of a mass transit vehicle generally at floor level in order to bridge or cover any existing gap and level difference between the transit vehicle floor and an adjacent platform or other exit area.

Known devices which attempt to accomplish the above described "bridging" action include European Patent Application 94400475.3 (Publication No. 0618125A1), and European Paten Application 86113060.7 (Publication No. 08.04.87). However, these devices either do not provide smooth transition between the car floor and platform or require extensive modification to the vehicle structure in order to accommodate the operative portions of the bridge plate.

U.S. Pat. No. 5,537,869, entitled DEVICE FOR FACILITATING ACCESS TO A RAIL VEHICLE HAVING EXTENDABLE RAMP ASSEMBLY is difficult to install because principal portions of it are mounted within the floor of the transit vehicle, and require cutting away portions of the floor support structure.

SUMMARY OF THE INVENTION

The present invention is a cartridge bridge plate assembly for mounting under a floor structure of a transit vehicle adjacent a passenger door opening, the floor structure having a generally planar floor surface. The cartridge bridge plate assembly has a frame assembly and a frame assembly attachment means engageable with the floor structure for attaching the frame assembly underneath the floor structure of the transit vehicle.

It has a bridge plate connected for movement relative to the frame assembly for covering a gap between the generally planar floor surface of the transit vehicle and an adjacent stationary surface such as a platform to facilitate passenger ingress and egress between the transit vehicle and the stationary surface when the transit vehicle is stopped.

It also has a bridge plate positioning means connected to the bridge plate for positioning the bridge plate and accommodating motion of the bridge plate relative to the frame assembly from a stowed position within the frame assembly beneath the floor structure of the transit vehicle to an extended position for covering the gap. A motor is connected to the bridge plate positioning means for moving the bridge plate from the stowed position to the extended position and from the extended position to the stowed position.

The system includes a power connection to the motor, and a drive screw connected to and rotated by the motor. It has a drive nut engaging the drive screw to be translated thereby, the drive nut having mechanical connection to the bridge plate positioning means to move the bridge plate from the stowed position to the extended position and from the extended position to the stowed position. The system also has an elevating means connected to the bridge plate positioning means for elevating an inner edge of the bridge plate to match an elevation of the floor surface of the transit vehicle.

OBJECTS OF THE INVENTION

It is, therefore, one of the primary objects of the present invention is to provide a bridge plate for a transit vehicle for covering a gap between the transit vehicle and a platform surface adjacent the transit vehicle when it is stopped at a station.

Another object of the present invention is to provide a bridge plate which serves as a ramp for accommodating a slight difference in elevation between the floor of a transit vehicle and an adjacent platform to facilitate egress and ingress of passengers.

Still another object of the present invention is to provide a bridge plate assembly which can easily be mounted on a transit vehicle without extensive modification of the transit vehicle.

Yet another object of the present invention is to provide a bridge plate assembly which may be attached directly under the floor structure of a transit vehicle.

A further object of the present invention is to provide a bridge plate which provides a continuous surface between the floor surface of the transit vehicle on which it is installed, and the inner edge of the bridge plate.

It is an additional object of the present invention to provide a bridge plate for a transit vehicle which can be locked in a stowed position.

Still yet another object of the present invention is to provide a bridge plate for a transit vehicle which can be locked in an extended position.

Yet still another object of the present invention is to provide a bridge plate for a transit vehicle which may be manually unlocked when it is in the extended position and manually moved to a stowed position.

A still further object of the present invention is to provide a bridge plate which may be extended or retracted, locked or unlocked by electrical signals.

An additional object of the present invention is to provide a bridge plate which is extended and retracted by a screw drive having a single screw.

In addition to the various objects and advantages of the present invention which have been generally described above, there will be various other objects and advantages of the invention that will become more readily apparent to those persons who are skilled in the relevant art from the following more detailed description of the invention, particularly, when the detailed description is taken in conjunction with the attached drawing Figures and with the appended claims.

BRIEF DESCRIPTION OF THE DRAWINGS

FIG. 1 shows a transit vehicle having the cartridge bridge plate assembly of the present invention attached to a floor structure of a railway transit vehicle.

FIG. 2 shows the bridge plate in an extended position to provide continuous surface between the floor of the transit vehicle and an adjacent platform.

FFIG. 3 is a schematic illustration showing principal features of the assembly with the bridge plate in the extended position.

Figure 4:
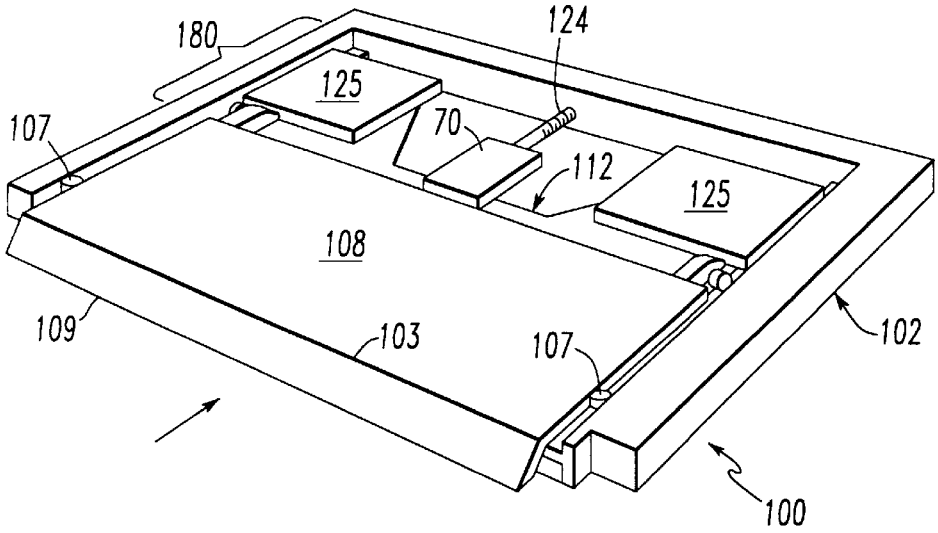

FIG. 4 is a schematic illustration showing principal features of the assembly with the bridge plate in a stowed position.

Figure 5:
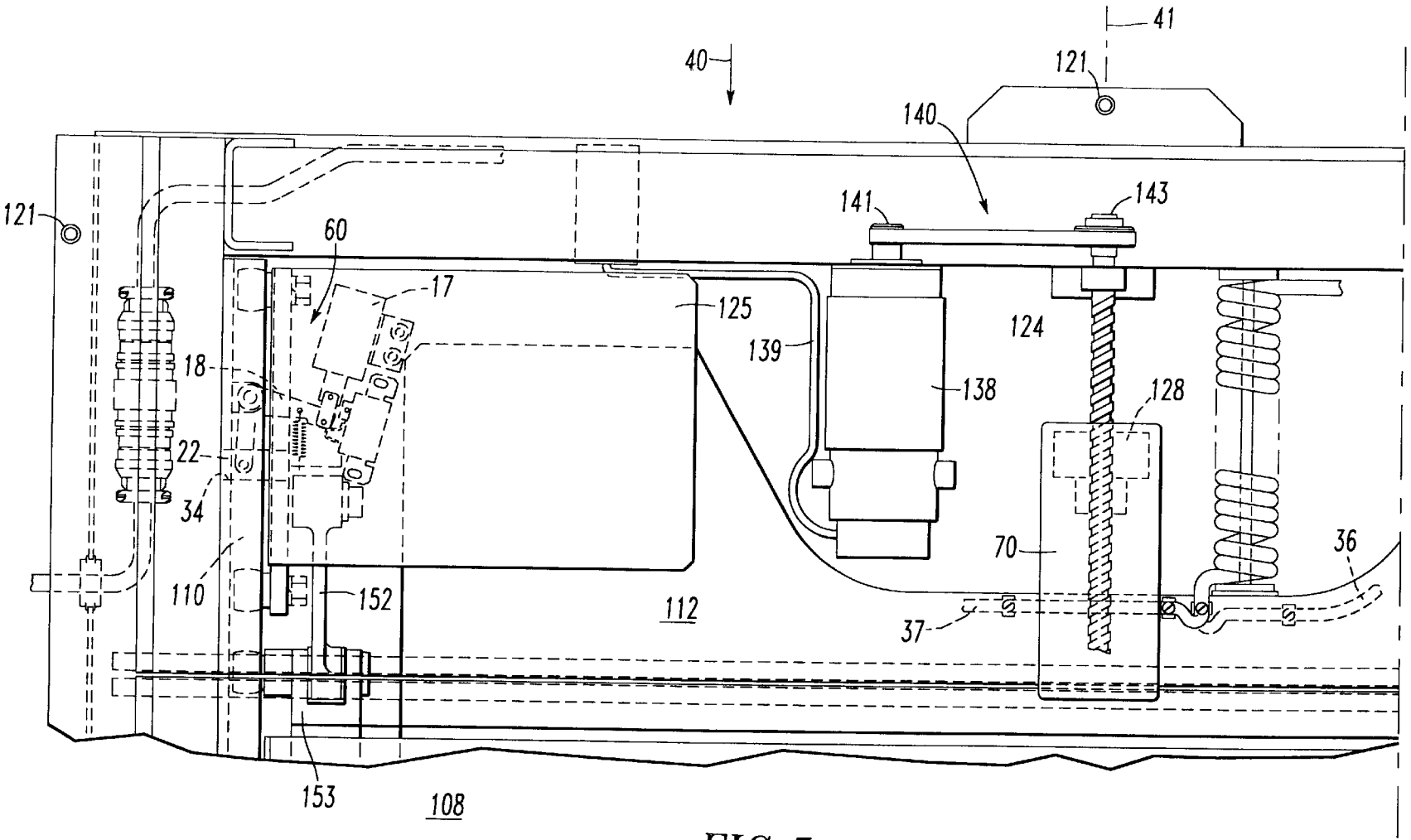

FIG. 5 is a portion of an assembly drawing of a presently preferred embodiment which shows a portion of the frame, the motor, a portion of the drive screw and a portion of the positioning means for the bridge plate.

Figure 6:
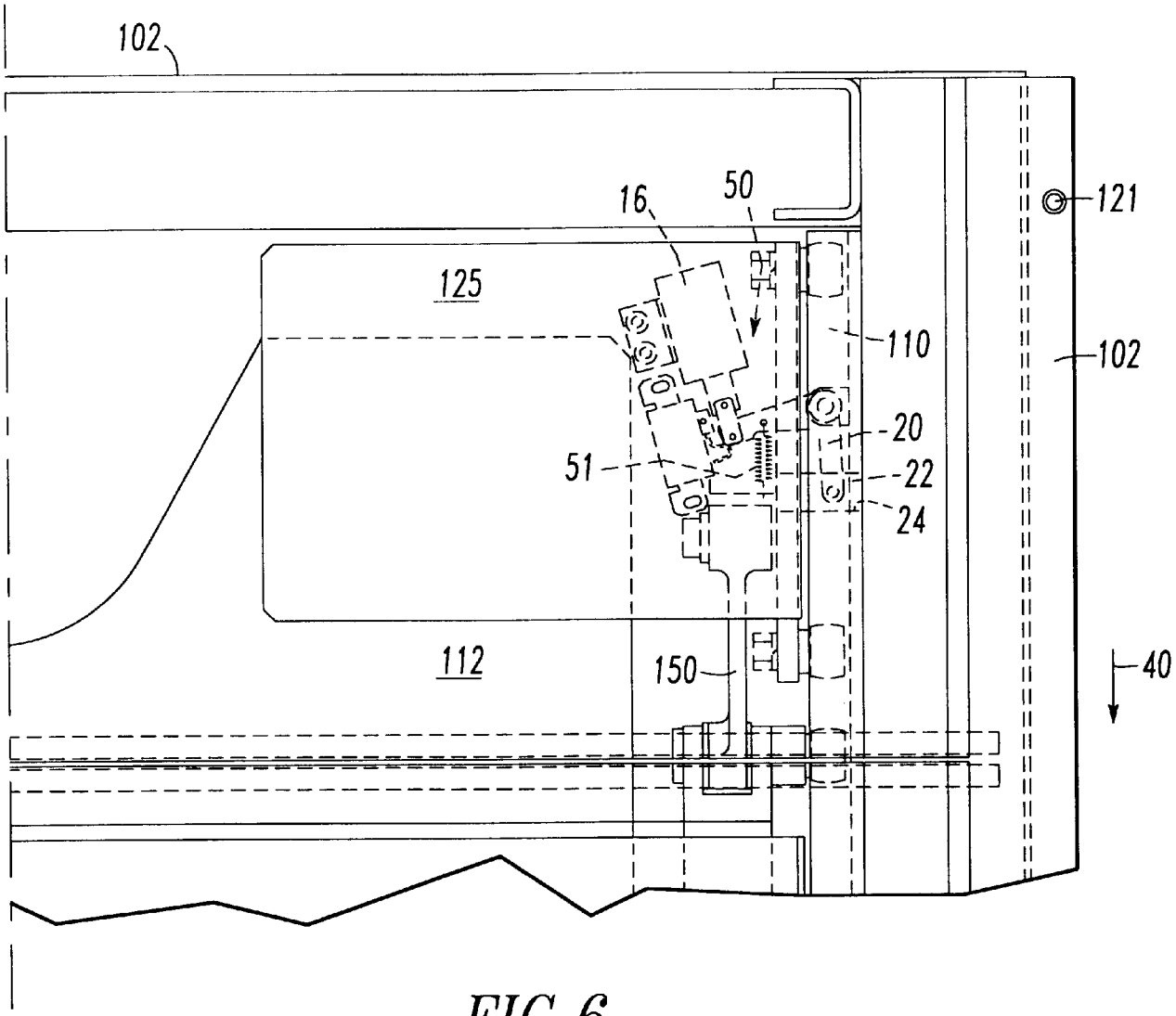

FIG. 6 shows a portion of the presently preferred embodiment showing portion of the frame, a portion of the drive screw and a portion of the positioning means for the bridge plate.

Figure 7:
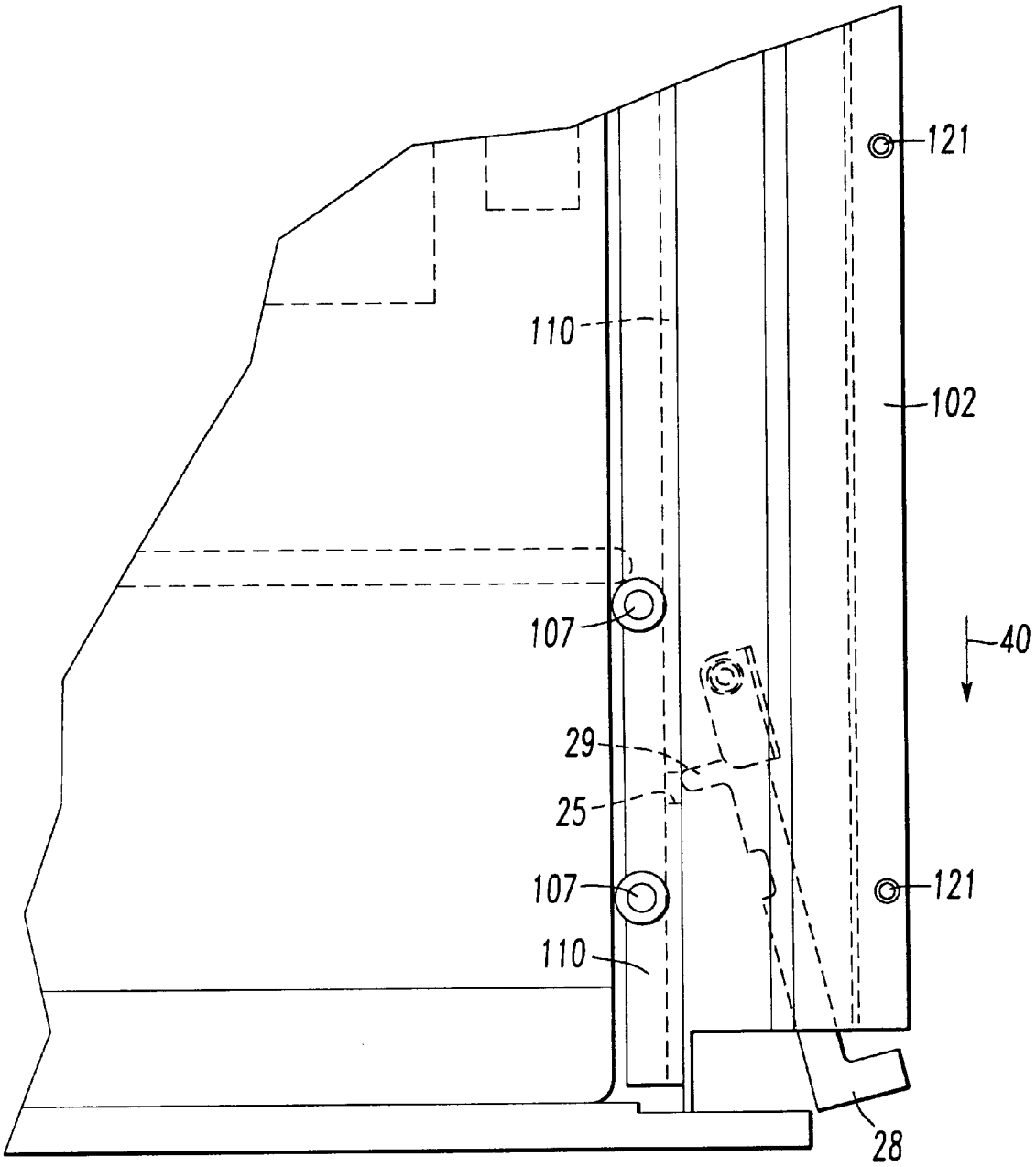

FIG. 7 shows a portion of the presently preferred embodiment which Shows a drive link and a manual brake release.

Figure 8:
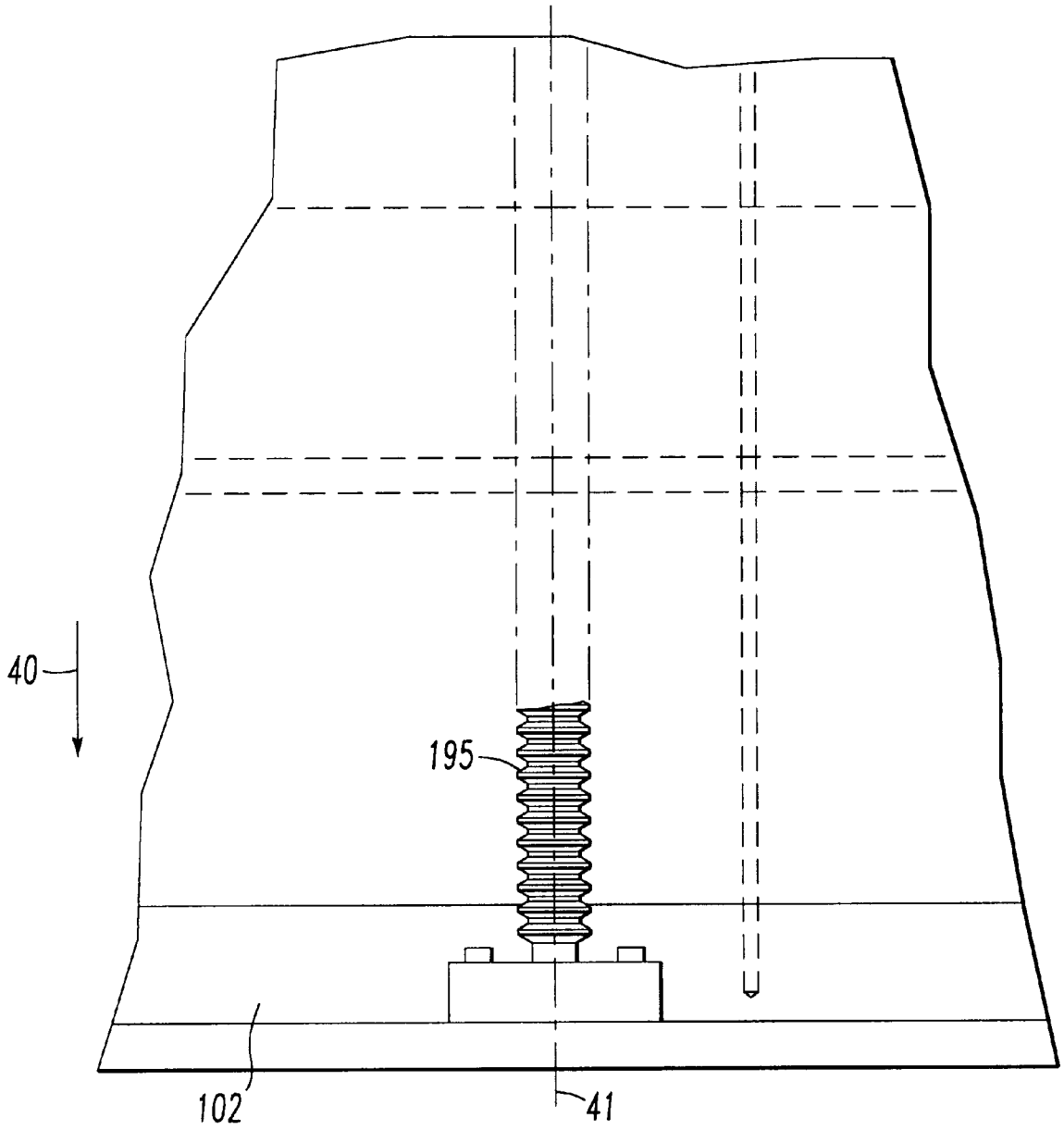

FIG. 8 shows a central portion of the presently preferred embodiment and shows a bellows for covering the drive screw.

Figure 9:
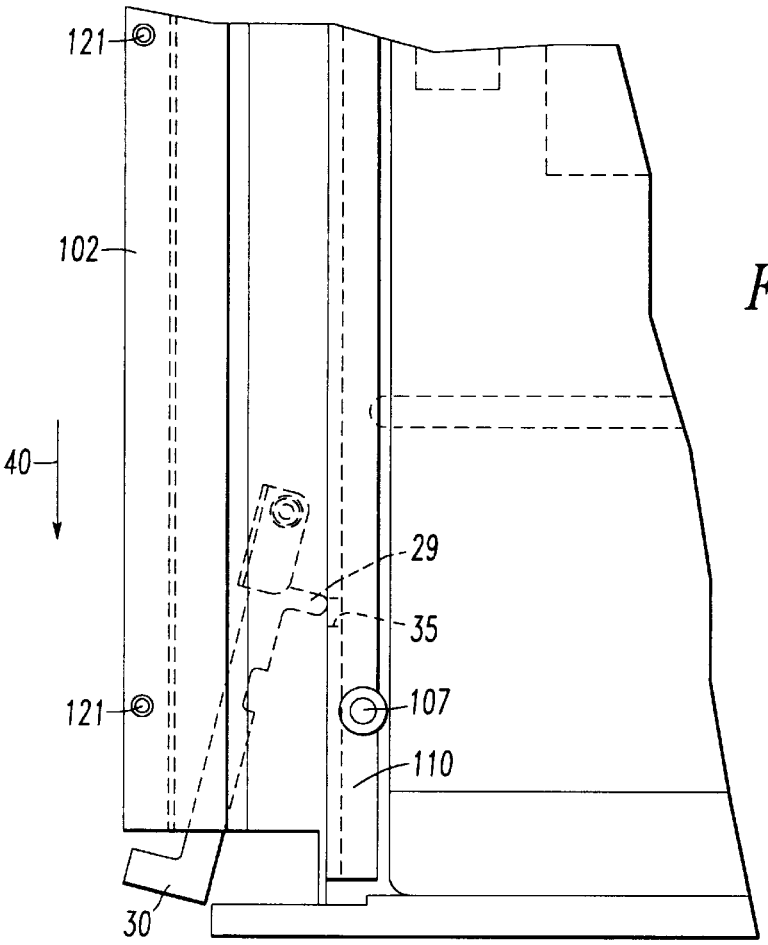

FIG. 9 shows a portion of the presently preferred embodiment which shows a drive link and a manual brake release.

Figure 10:
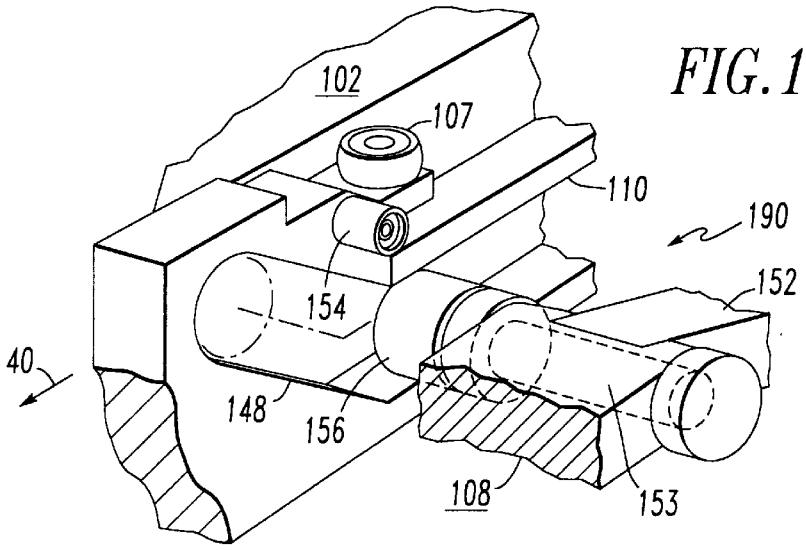

FIG. 10 shows a means for elevating the inner edge of the bridge plate to the elevation of the floor of the transit vehicle.

BRIEF DESCRIPTION OF THE PRESENTLY PREFERRED AND VARIOUS ALTERNATIVE EMBODIMENTS OF THE INVENTION

Prior to proceeding to the much more detailed description of the present invention, it should be noted that identical components which have identical functions have been identified with identical reference numerals throughout the several views illustrated in the drawing Figures, for the sake of clarity and understanding of the invention.

FIGS. 1 and 2 show the cartridge bridge plate assembly, generally designated 100, mounted under the floor structure 11 of a transit vehicle 2 adjacent a passenger door opening 4; the floor structure 11 having a generally planar floor surface 10. Transit vehicle 2 is shown having wheel 12 for travelling on rail 14. FIG. 1 shows the assembly 100 with the bridge plate 108 in a 6<stowed position, and FIG. 2 shows the bridge plate 108 in an extended position to provide a continuous surface between the floor 10 of the transit vehicle 2 and a stationary surface 9. Door 6 of the transit vehicle 10 is shown in the open position. Outer end 109 of bridge plate 108 rests on stationary surface 9, which may be a platform at a transit station.

Figure 3:
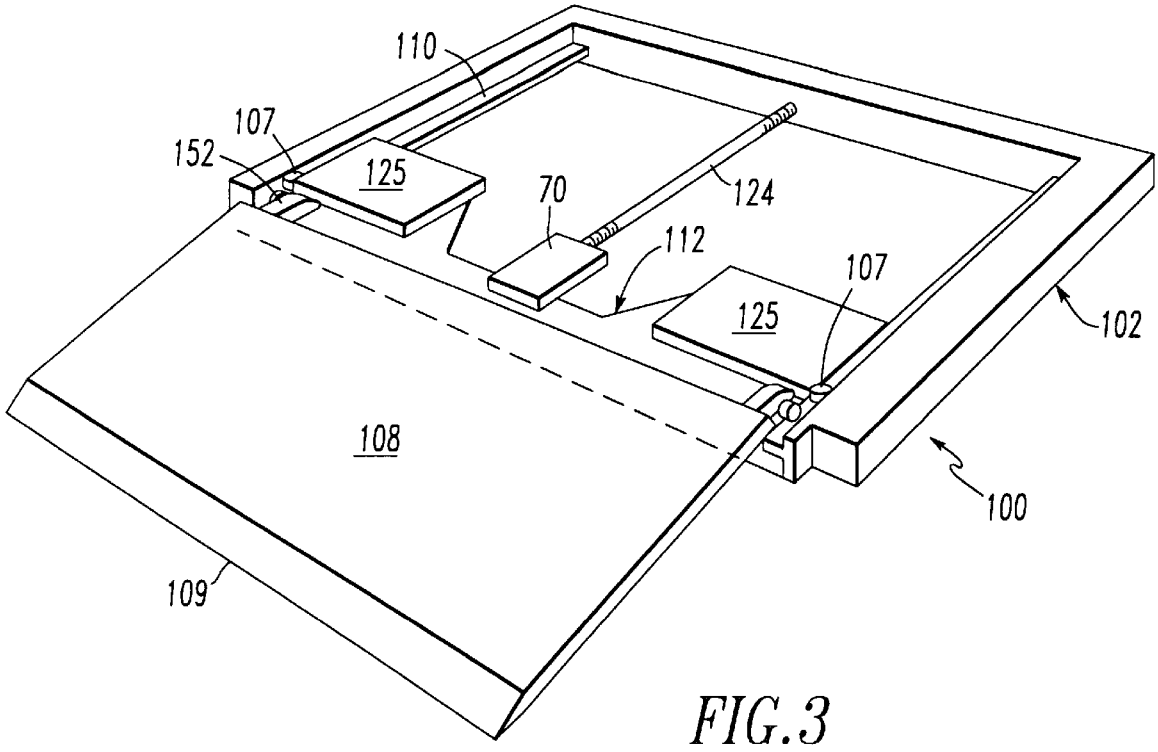

FIGS. 3 and 4 are schematic drawings of the cartridge bridge plate assembly 100. FIG. 3 shows the assembly 100 with bridge plate 108 extended, and FIG. 4 shows the assembly 100 with the bridge plate 108 retracted to a stowed position.

Cartridge bridge plate assembly 100 has a frame assembly 102 and a frame assembly attachment means 121 (not shown in this Figure) engageable with the floor structure 11 for attaching the frame assembly 102 underneath the floor structure 11 of the transit vehicle.

Bridge plate 108 is connected for movement relative to the frame assembly 102 by bridge plate positioning means 180 shown in FIG. 4. Bridge plate 108 is to facilitate passenger ingress and egress between the transit vehicle 2 and the stationary surface 9 when the transit vehicle is stopped.

Bridge plate positioning means 180 is connected to bridge plate 108 for positioning bridge plate 108 and accommodating motion of the bridge plate 108 relative to the frame assembly 102 from a stowed position within the frame assembly 102 beneath the floor structure 11 of the transit vehicle 2 to the extended position shown in FIG. 3. A motor 138 (not shown in this Figure) is connected to the bridge plate positioning means 180 for moving the bridge plate 108 from the stowed position to the extended position and from the extended position to the stowed position. FIG. 3 shows internal track 110 which is for guiding bridge plate positioning means 180. Two vertical axis rollers 107 are shown in FIG. 7. These are attached to one side of frame assembly 102. Likewise, FIG. 9 shows a vertical axis roller 107, attached to the opposite side of frame assembly 102. Vertical axis rollers 107 are for guiding bridge plate 108 and bridge plate positioning means 180.

FIGS. 5 through 9 show portions of an assembly drawing of the presently preferred embodiment, with the bridge plate 108 in the stowed position. The direction arrow 40 in these Figures shows the direction in which bridge plate 108 moves from the stowed position to the deployed position. Arrows 40 are added to show the relative orientations of the Figures. Likewise, the centerline 41 of the entire assembly 100 is shown in FIGS. 5,6, and 8.

FIG. 5 shows motor 138 and motor power connection 139. A drive screw 124 has motive power connection, generally designated 140, to motor 138. Preferably, this connection 140 consists of pulley 141 which is driven by motor 138, drive belt 142 and pulley 143 connected to drive screw 124. Assembly 100 has a drive nut 128 engaging the drive screw 124 to be translated thereby, the drive nut 128 having mechanical connection to the bridge plate positioning means 180 to move the bridge plate 108 from the stowed position to the extended position and from the extended position to the stowed position. The system also has an elevating means generally shown as 190, which can be seen in FIG. 10. Elevating means 190 is connected to the bridge plate positioning means 180 for elevating the inner edge 123 of the bridge plate 108 to match the elevation of the floor surface 10 of the transit vehicle 2. FIGS. 5 through 9 show the frame assembly attachment means 121, which consists of holes in frame 102 for bolts for connection to vehicle floor structure 11.

In the presently preferred embodiment, the bridge plate positioning means, shown as 180 in FIG. 4, includes base plate 112 and one or more pivoted links such as 152 shown in FIG. 5 or 150 shown in FIG. 6. These connect base plate 112 to bridge plate 108. Drive nut 128 has mechanical connection to base plate 112. In the presently preferred embodiment, drive nut 128 is mounted on yoke plate 70, which is attached to base plate 112.

In the presently preferred embodiment, one or more track means 110 are provided for guiding base plate 112. Track means 110 may either be attached to or formed as a part of frame 102.

The preferred elevating means is generally shown as 190 in FIG. 10. It has roller 156 attached to outer end 153 of pivoted link 152. Roller 156 engages track 110, and is attached to link 152. When link 152 moves in the bridge plate extending direction 40, roller 156 encounters the upward sloping portion 148 of track 110. This elevates the outer end 153 of pivoted link 152, which is connected to inner edge 123 of bridge plate 108. This elevates inner edge 123 of bridge plate 108 to match the elevation of floor 10 of transit vehicle 2.

In the presently preferred embodiment, a lock means, generally designated 50 and shown in FIG. 6, is provided. Lock means 50 includes lock actuator 16, moveable lock portion 20, and lock plunger 22. Lock plunger 22 engages aperture 24 in frame 102, shown in FIG. 6, to lock bridge plate 108 in the stowed position. FIG. 7 shows aperture 25 which receives plunger 22 of moveable lock portion 20 when bridge plate 108 is in the extended position, to lock bridge plate 108 in the extended position. Preferably, lock actuator 16 and moveable lock portion 70 of lock 50 are attached to a lock attachment plate 125, which is attached to base plate 112.

In the presently preferred embodiment, a lock power connection 36 is provided for supplying power to lock actuator 16. Preferably, power is used for unlocking lock 50 by moving moveable lock portion 20 to the unlocking position, and spring 51 is used for biasing moveable lock portion 20 toward the locking position. Hence, in the event of power loss, if the system is locked in either the stowed or locked position, it will remain locked. Preferably, lock power connection 36 is an electrical power connection.

Preferably, the system also has a second lock, generally designated 60 having actuator 17 connected to second lock moveable portion 18, as shown in FIG. 5. Moveable lock portion 18 is for inserting a lock plunger 22 into an aperture 34 for locking bridge plate 108 in the stowed position, or into an aperture 35 for locking in the extended position. Second lock actuator 17 has lock power connection 37, which preferably is an electrical power connection. Preferably, lock actuator 17 and moveable lock portion 18 of lock 60 are attached to a lock attachment plate 125, as shown in FIG. 5.

The presently preferred embodiment also has a manual unlocking member 28 shown in FIG. 7. Member 28 has unlocking plunger 29 which presses plunger 22 out of aperture 25. This is provided so that if the system fails, and bridge plate 108 is locked in the extended position, it can be manually unlocked so bridge plate 108 can be pushed to the stowed position.

Likewise, a second manual unlocking member 30 is also provided. This is for pressing lock plunger 22 of moveable lock portion 18 out of aperture 35 to manually unlock bridge plate 108.

It is preferred that the drive screw 24 and drive nut 28 have sufficient pitch and sufficiently low friction that they are back driveable. This is done when the bridge plate 108 is in the extended position and the system fails to retract it to the stowed position. In that case, after manually unlocking the bridge plate 108, bridge plate 108 is manually pushed inward to the stowed position. Drive nut 28 causes drive screw 24 and motor 138 to rotate, as the bridge plate 108 is moved to the stowed position.

Preferably, guide rollers, including rollers 107, are used to guide base plate 112 relative to frame assembly 102.

Preferably, a bellows, 195 is mounted to enclose a major portion of drive screw 124 when bridge plate 108 is in the stowed position, to protect drive screw 124 from harmful environmental factors.

While a presently preferred and various additional alternative embodiments of the instant invention have been described in detail above in accordance the patent statutes, it should be recognized that various other modifications and adaptations of the invention may be made by those persons who are skilled in the relevant art without departing from either the spirit or the scope of the appended claims.

We claim:

1. A cartridge bridge plate assembly for mounting under a floor structure of a transit vehicle adjacent a passenger door opening, such floor structure having a generally planar floor surface, said cartridge bridge plate assembly comprising:

(a) a frame assembly;

(b) a frame assembly attachment means engageable with such floor structure for attaching said frame assembly underneath such floor structure of such transit vehicle;

(c) a bridge plate connected for movement relative to said frame assembly for covering a gap between such generally planar floor surface of such transit vehicle and an adjacent stationary surface to facilitate passenger ingress and egress between such transit vehicle and such stationary surface when such transit vehicle is stopped;

(d) a bridge plate positioning means connected to said bridge plate for positioning said bridge plate and accommodating motion of said bridge plate relative to said frame assembly from a stowed position within said frame assembly beneath such floor structure of such transit vehicle to an extended position for covering such gap;

(e) at least three vertical axis rollers attached to said frame assembly for guiding said bridge plate and said bridge plate positioning means;

(f) a motor connected to said bridge plate positioning means for moving said bridge plate from said stowed position to said extended position and from said extended position to said stowed position;

(g) a power connection to said motor;

(h) a single drive screw positioned in a substantially central location of said bridge plate assembly, said drive screw connected to and rotated by said motor;

(i) a drive nut engaging said drive screw to be translated thereby, said drive nut having mechanical connection to said bridge plate positioning means to move said bridge plate from said stowed position to said extended position and from said extended position to said stowed position; and (j) an elevating means connected to said bridge plate positioning means for elevating an inner edge of said bridge plate to match an elevation of such floor surface of such transit vehicle.

2. A cartridge bridge plate assembly, according to claim 1, wherein said bridge plate positioning means includes a base plate and at least one pivoted link connecting said bridge plate to said base plate, said drive nut being attached to said base plate.

3. A cartridge bridge plate assembly, according to claim 1, wherein said assembly includes at least one track means at least one of attached to and formed as a part of said frame assembly for guiding said base plate.

4. A cartridge bridge plate assembly, according to claim 1 wherein said elevating means includes at least one track having an upturned end portion for upwardly guiding said inner edge of said bridge plate as said bridge plate is moved to said extended position.

5. A cartridge bridge plate assembly, according to claim 1, wherein said cartridge bridge plate assembly further includes at least one lock means for securing said bridge plate when it is in said extended position and when it is in said stowed position.

6. A cartridge bridge plate assembly, according to claim 5, wherein said at least one lock means includes a lock actuator and a moveable lock portion.

7. A cartridge bridge plate assembly, according to claim 6, wherein said lock means further includes a lock power connection attached to said lock actuator.

8. A cartridge bridge plate assembly, according to claim 7, wherein said lock power connection is an electrical power connection.

9. A cartridge bridge plate assembly, according to claim 6, wherein said cartridge bridge plate assembly further includes at least one manual unlocking member for unlocking said bridge plate assembly when it is in said extended position.

10. A cartridge bridge plate assembly, according to claim 6, wherein said lock actuator and moveable lock portion include a mechanical connection to said bridge plate, said moveable lock portion including a lock plunger, said frame assembly having an inner aperture to be engaged by said lock plunger to lock said bridge plate in said stowed position and an outer aperture to be engaged by said lock plunger to lock said bridge plate in said extended position.

11. A cartridge bridge plate assembly, according to claim 10, wherein said cartridge bridge plate assembly further includes a manual unlocking member for moving said lock plunger out of said outer aperture to unlock said bridge plate.

12. A cartridge bridge plate assembly, according to claim 1, wherein said drive screw and drive nut have a sufficiently great pitch and low friction that they are back-driveable, so that said bridge plate can be manually moved from said extended position to said stowed position.

13. A cartridge bridge plate assembly, according to claim 1, wherein said assembly further includes a bellows enclosing said drive screw when said bridge plate is in said stowed position for protecting said drive screw, an outer end of said bellows being attached to an outer portion of said frame assembly and an inner end of said bellows being connected to said bridge plate positioning means.

* * * * *